US005576820A

United States Patent [19]

Hagihara et al.

[11] Patent Number: 5,576,820

[45] Date of Patent: Nov. 19, 1996

[54] XEROGRAPHIC APPARATUS WITH A DETACHABLE CORONA CHARGER

[75] Inventors: Hideaki Hagihara; Masakiyo Okuda, both of Nara, Japan

[73] Assignee: Sharp Kabushiki Kaisha, Osaka, Japan

[21] Appl. No.: 455,040

[22] Filed: May 31, 1995

[30] Foreign Application Priority Data

Jun. 24, 1994 [JP] Japan ..... 6-143047

[51] Int. Cl.[6] ..... G03G 15/02

[52] U.S. Cl. ..... 355/274; 355/200

[58] Field of Search ..... 355/219, 221, 355/274, 200, 210, 277; 361/229; 250/325, 324, 326

[56] References Cited

U.S. PATENT DOCUMENTS 5,126,796 6/1992 Fujii et al. ..... 355/274 X

FOREIGN PATENT DOCUMENTS 63-163870 7/1988 Japan .

2-212858 8/1990 Japan .

4-230777 10/1992 Japan .

2199537 7/1988 United Kingdom .

*Primary Examiner*—Joan H. Pendegrass

*Assistant Examiner*—Sophia S. Chen

*Attorney, Agent, or Firm*—David G. Conlin; Brian L. Michaelis

[57] ABSTRACT

A xerographic apparatus which allows simple attachment and detachment of a corona charger type transferring device, wherein the apparatus includes a first engagement section which matches a first positioning protrusion section provided at the holder located at one end of the corona charger type transferring device, a second engagement section which matches a second elastically deformable protrusion section for engagement with the xerographic device and which is provided at the holder located at the other end, biasing means for biasing the transferring device upward, and a first sidewall having an opening section which is located facing the second protrusion section in order to confine the site of the second protrusion section to be subjected to elastic deformation by pressing and allows application of pressure therethrough.

4 Claims, 9 Drawing Sheets

REAR SIDE
FRONT SIDE
56
36b
32b
101
40
33
52
34
35
33
6
50
46
102
31
d
37
54
36a
48
38
42
32a
39
44

XEROGRAPHIC APPARATUS WITH A DETACHABLE CORONA CHARGER

BACKGROUND OF THE INVENTION

1. Field of the Invention

The present invention relates to a xerographic apparatus such as a copier, laser printer, etc., and more particularly to a transferring device for transferring an image formed on a photoconductor built in such an apparatus as mentioned above.

2. Description of the Related Art

The configuration of a conventional corona charger (transferring device) and a method of mounting it in the body of a xerographic apparatus will now be explained with reference to FIG. 7 through FIG. 10. According to a first example of the prior art (FIG. 7) disclosed in Japanese Patent Application Disclosure HEI 4-230777, a corona charger type transferring device 100 is equipped with a charger wire 83 in a corona case 82 on the side of which are provided a holder 90 at the front of the device (the front of the body of the xerographic apparatus, that is, the end of the body in the direction opposite to that indicated by the arrow A in FIG. 7), and a positioning shaft 87 at the rear of the device (the rear of the body of the xerographic apparatus, that is, the end of the body in the direction of the arrow A in FIG. 7), with a plate spring member 88 and a guide member 89 provided at the bottom of the corona case 82. Referring to FIG. 8, the aforementioned guide member 89 is inserted into a base plate guide rail 91 at the side of the body (base plate side) of the xerographic apparatus, for mounting the corona charger type transferring device 100. Here, the positioning of the corona charger type transferring device 100 is accomplished by proper insertion of the positioning shall 87 in a recess portion of the body. Since the aforementioned method utilizes holding power of the plate spring member 88, no additional means (vis or the like) is provided for securing the corona charger type transferring device 100 to the body of the xerographic apparatus.

A second example of the prior art shown in FIG. 9 is a method of securing a holder section 85 of a corona charger type transferring device 100 to a base plate 81 with a vis 86. According to a third example of the prior art shown in FIG. 10, a wire holder 85 for securing a charger wire 83 is formed integrally with a base plate 81, with a corona case 82 secured directly to the base plate 81 with a vis 86. The charger wire 83 is also secured directly to the base plate 81 with a vis 84.

With the first example of the prior art, although the user may mount and demount the corona charger type transferring device, in cases where the user has forgotten to remount the corona charger type transferring device which has been removed for some reason, or has failed to properly insert it in the guide rail, failure of image formation, damage to the corona charger type transferring device and other troubles occur. Further, in cases where the body of the xerographic apparatus is designed to be capable of managing such troubles, it becomes necessary to provide the body with special additional parts or an improved insertion guide as countermeasures, and such provision results in a great increase in cost.

On the other hand, according to the second embodiment or the prior art, in cases where the corona charger type transferring device is secured with a screw so that only service technicians may remove it, it becomes necessary to expend much time and effort to remove the vis and a driver must also be used inside the body of the xerographic apparatus if the screw is located inside the body; a series of these procedures requires advance special training and use of an extra-short driver (a special-purpose tool), and thus is a time-consuming job.

According to the third example of the prior art, replacement of the inner wire electrodes is difficult and complicated work even for service technicians.

SUMMARY OF THE INVENTION

An object of the present invention is to allow simplified attachment and detachment of a corona charger type transferring device to and from a xerographic apparatus.

According to the invention, there is provided a xerographic apparatus which is equipped with a detachable corona charger type transferring device with holders located at the both ends of a charger box for fixing a charge wire, characterized by comprising:

a first engagement section which matches a first protrusion section provided at the holder located at one end of the transferring device, for positioning with respect to the apparatus;

a second engagement section which matches a second elastically deformable protrusion section for engagement with the apparatus and which is provided at the holder located at the other end of the transferring device;

biasing means for biasing the transferring device upward; and a first sidewall having an opening section which is located facing the second protrusion section in order to confine the site of the second protrusion section to be subjected to elastic deformation by pressing and which allows the pressing therethrough.

According to the invention, there is also presented an improved version of the aforementioned xerographic apparatus which is characterized by comprising a second sidewall provided opposite to the first sidewall relative to the second protrusion section in order to prevent excess elastic deformation of the second protrusion section.

In addition, according to the invention, there is provided a xerographic apparatus which is equipped with a detachable corona charger type transferring device with holders located at the both ends of a charger box for fixing a charger wire, and the body of which may be pivotably divided into an upper unit with a photoconductor drum unit and a lower unit with the transferring device, characterized by comprising:

a first engagement section which matches a first protrusion section provided at the holder located at one end of the transferring device, for positioning with respect to the apparatus;

a second engagement section which matches a second elastically deformable protrusion section for engagement with the apparatus and which is provided at the holder located at the other end of the transferring device;

biasing means for biasing the transferring device upward;

a first sidewall having an opening section which is located facing the second protrusion section in order to confine the site of the second protrusion section to be subjected to elastic deformation by pressing and allows the pressing therethrough; and positioning means provided at the side of the photoconductor drum unit for determining the positional relationship between the photoconductor drum unit and transferring unit only when the two units are in their closed position.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
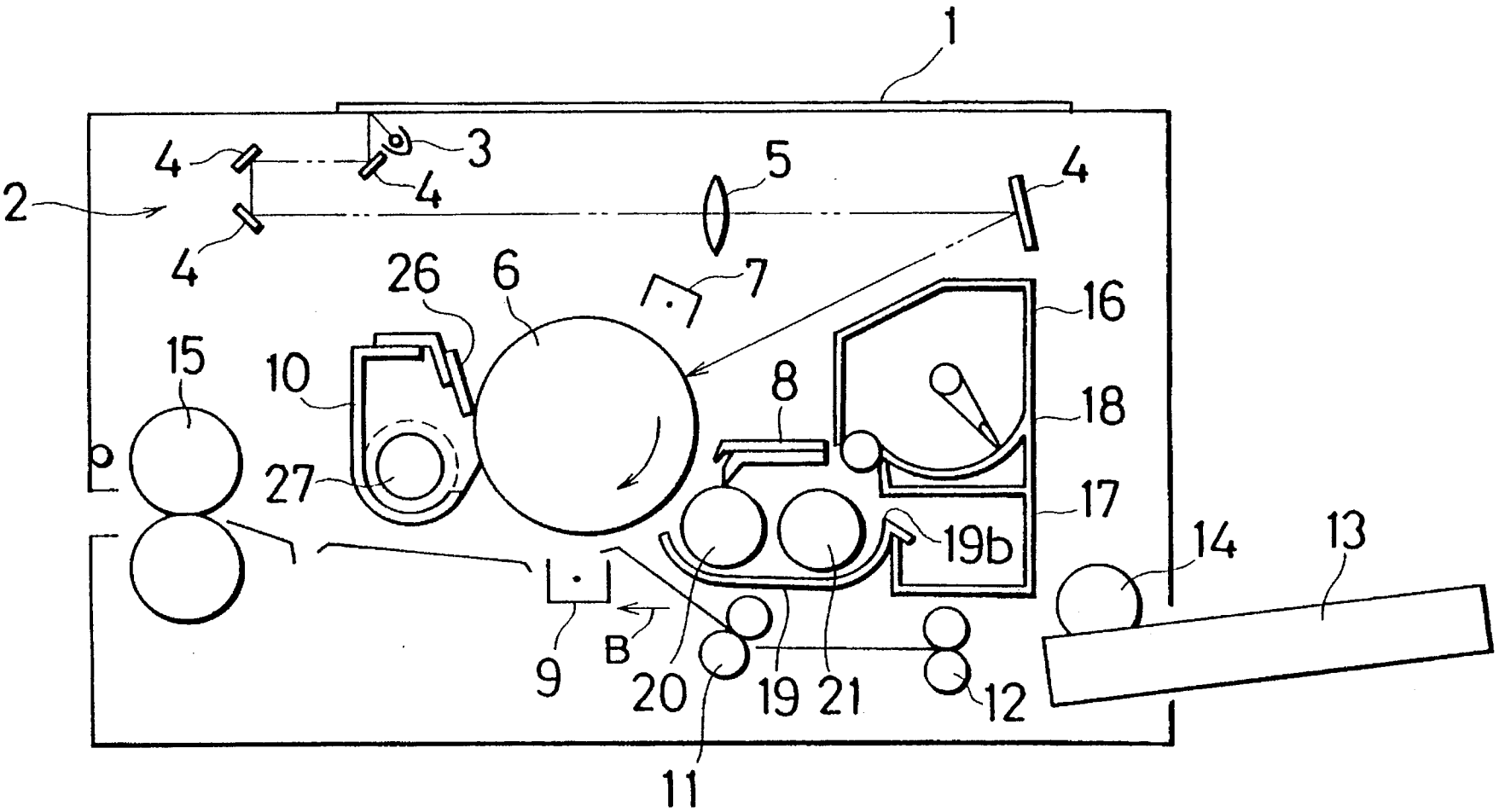
FIG. 1 is a cross sectional view of a xerographic apparatus equipped with a corona charger type transferring device according to the present invention.

Now referring to the drawings, preferred embodiments of the invention are described below.

A first embodiment of the present invention will now be explained with reference to FIG. 1 through FIG. 4.

As shown in FIG. 1, the present embodiment of a xerographic apparatus, or a copier, comprises a document platen 1 on its upper surface section and is equipped with an optical exposure system station 2 located under the document platen 1. This optical exposure system station 2 comprises a light source lamp 3 which emits light for scanning a document (not shown) positioned on the document platen 1, a plurality of reflecting mirrors 4 which guide the reflected-light from the document to a photoconductor drum 6 and a lens unit 5 arranged in the optical path of the aforementioned reflected light. On the outer circumference of the photoconductor drum 6, there are provided an electrifying charger 7 for electrifying the surface of the photoconductor drum 6 to a given potential, an image eraser (not shown), a developing device 8 which develops the electrostatic latent image formed on the surface of the photoconductor drum 6, a transferring charger 9 for transferring the toner image on the surface of the photoconductor drum 6 to a sheet, a cleaning device 10 for recovering the residual toner on the surface of the photoconductor drum 6, an antistatic device (not shown), etc. Provided at the sheet inlet side of the photoconductor drum 6 are a timing roller 11 for supplying sheets at a given timing, a feeding roller 12, a paper feeding cassette 13 and a paper feeding roller 14, while a fixing device 15 for fixing the toner image transferred to the sheet thereon is provided at the sheet outlet side of the photoconductor drum 6.

The aforementioned developing device 8 is equipped with a developer-supplying device 16 for supplying the developing device 8 with a developer and a developer-recovering container 17 for recovering the developer discharged from the developing device 8. The developer-supplying device 16 and developer-recovering container 17 are constructed into a one-piece developer supplying/recovering unit 18 which may be attached to the developing device 8 in a detachable manner. The developing device 8 comprises a container-like tank 19, and a magnet roller 20 and a stirring roller 21 are provided in the inside of the tank 19 which also receives developer comprising a carrier and toner. The carrier is comprised of a magnetic material on the surface of which is applied a resin coat layer to moderate the adhesive properties of the toner. The carrier is adapted, being stirred together with the toner, to frictionally electrify the toner so that the toner becomes adsorbed on the electrostatic latent image on the photoconductor drum 6. The magnet roller 20 is designed to adsorb the carrier by magnetic force to create a magnetic brush which is fed to supply the photoconductor drum 6 with the toner attached to the carrier by Coulomb force. The height of the bristles of the aforementioned brush is control led by a doctor (not shown). The stirring roller 21 supplies the developer in the tank 19. As shown in FIG. 1, the cleaning device 10 is equipped with a cleaning blade 26 for scraping the residual toner off the surface of the photoconductor drum 6 and a feeding screw 27 which feeds the waste toner recovered by the cleaning blade 26 in one direction.

Figure 4:
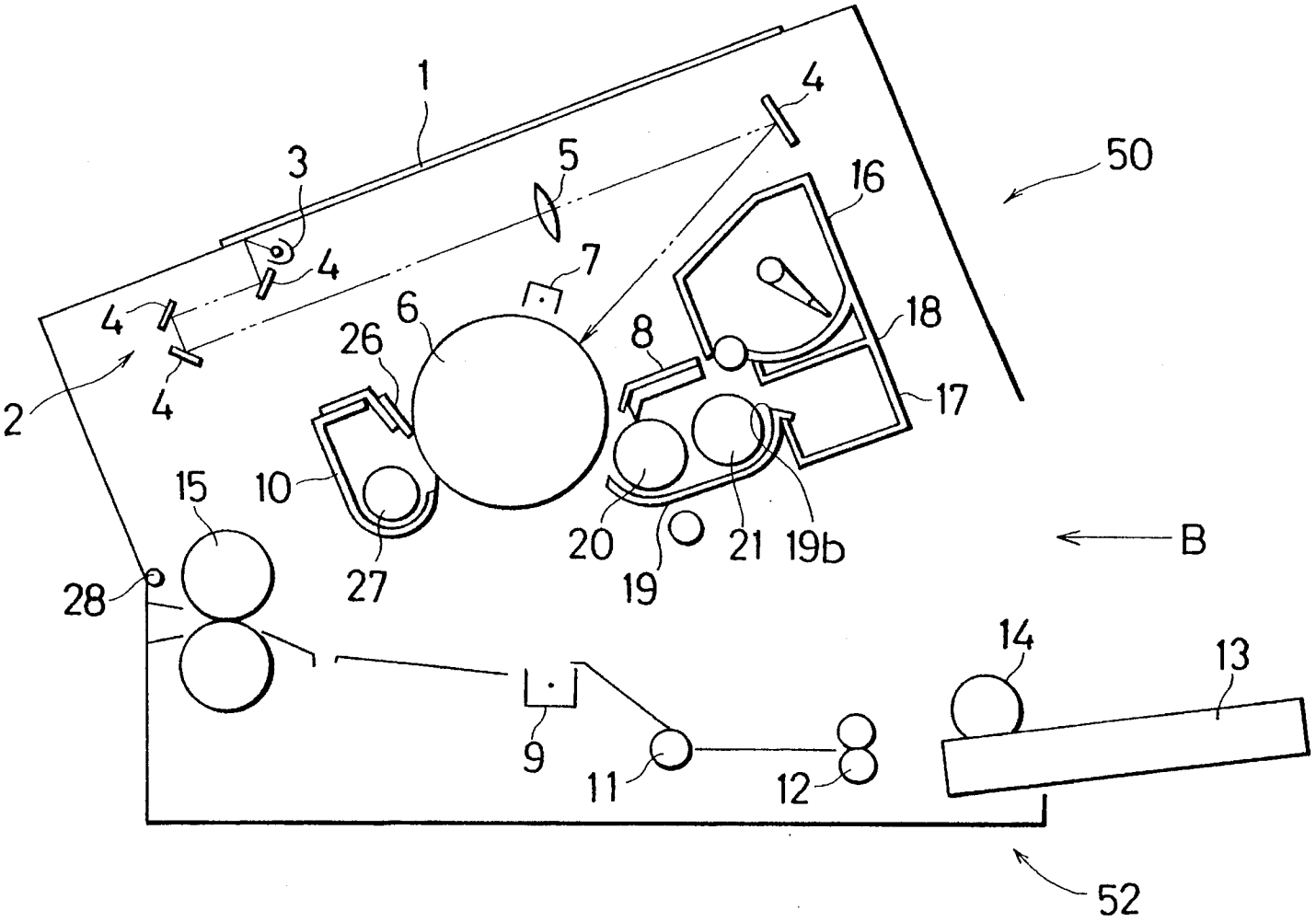
FIG. 4 is a cross sectional view of a two-section openable xerographic apparatus in an open state which is equipped with the corona charger type transferring device according to a second embodiment of the present invention.

The copying operation will now be explained in brief. When the copy-start switch (not shown) is turned on during standby after the completion of warming-up, a document sheet positioned on the document platen 1 is scanned with light from the light source lamp 3 of the optical exposure system station 2, and the photoconductor drum 6 is irradiated with light reflected from the document sheet via the reflecting mirrors 4 and lens unit 5. This irradiation results in the formation of an electrostatic latent image on the photoconductor drum 6 which has been electrified to a given potential with the electrifying charger 7, and the electrostatic latent image is developed by the toner supplied by the developing device 8. The toner image on the surface of the photoconductor drum 6 is transferred to a sheet supplied by a paper feeding cassette 13 with the transferring charger 9 and thermally fused into place by the fixing apparatus 15. A copy of the image, that is, a reproduction of the original on the document sheet, is produced in this way. The xerographic apparatus of the invention may be of the so-called clamshell type which allows, as shown in FIG. 4, upward opening (of a feeding path of the sheet) of the the upper section about an open/close fulcrum 28 positioned at the end of the paper outlet side, for jam clearance, etc.

Figure 2:
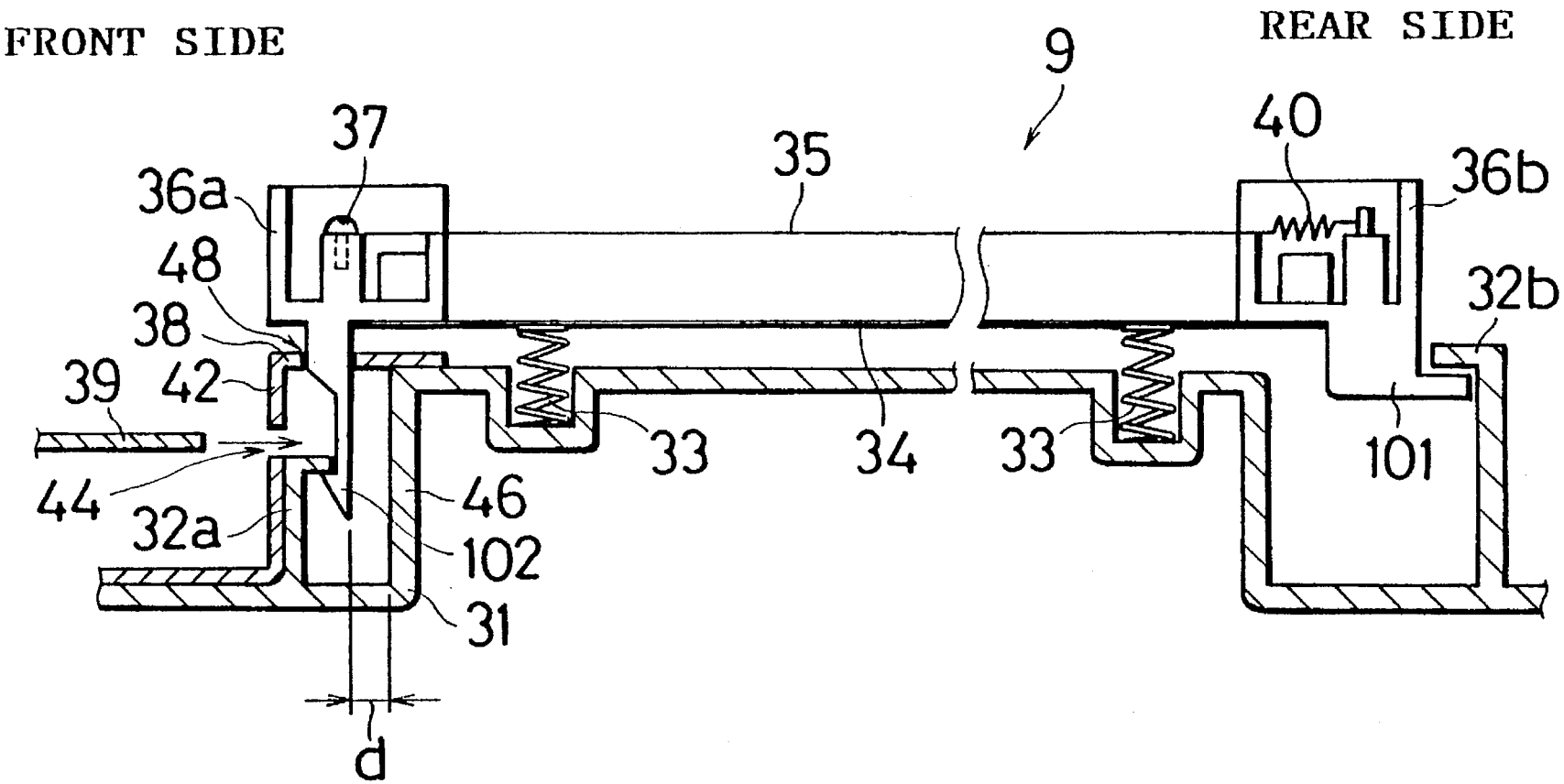
FIG. 2 is a cross sectional view of the corona charger type transferring device according to a first embodiment of the invention which is built in a xerographic apparatus, when viewed in the direction of the arrow B in FIG. 1.
Figure 3:
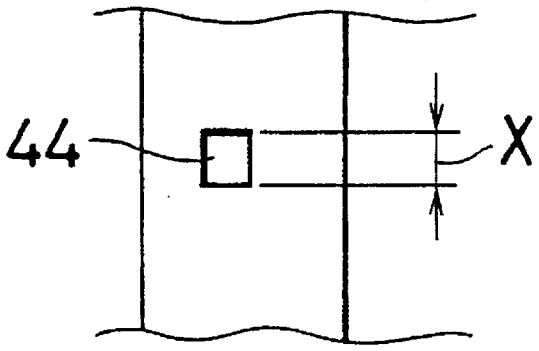
FIG. 3 is a view showing the configuration of an opening section in a first sidewall shown in FIG. 2.

In FIG. 2, the transferring charger unit 9 is constructed in such a manner that resin-made wire holders **36*a*, 36*b* are secured to the both sides of a "block u"-shaped metal charger box 34 over which a corona wire 35 is fixed. One end of the corona wire 35 is hooked to the holder 36***b* via a tension spring 40, and the other end secures the corona wire 35 to the holder 36*a* with a vis 37. As shown in FIG. 2, the bottom of a second protrusion section 102 of the charger wire holder 36*a* at the front side of the device is shaped as a (elastically deformable) claw which allows it to be hooked to a holder-hooking section (a second engagement section) 32*a* provided in the base plate 31. A front frame 38 (which comprises a first sidewall 42) is secured to the front side of the base plate 31. The frame 38 has a guide port for guiding the transferring charger unit 9 to a given position. Provided in the first sidewall 42 near this guide port is an opening section 44 which allows the release of a second protrusion section 102 of the charger wire holder 36*a* from the engaging hook section 32*a* of the base plate 31 by a press rod 39. As shown in FIG. 2, two springs 33 are inserted between the base plate 31 and charger case 34 so that the transferring charger unit 9 may be pressed upward while being set to be engaged with the base plate 31 (being in the state where the second protrusion section 102 of the holder 36*a* at the front side of the device is hooked to the second engagement section 32*a*, and the first a protrusion section 101 of the holder 36*b* at the rear side of the device is hooked to a holder-hooking section 32*b* [first engagement section]. Since the second protrusion section 102 of the wire holder 36*a* may be easily disengaged from the second engagement section 32*a* of the base plate 31 with the press rod 39 (a working tool), it is readily serviceable. This process requires the press rod 39 for the disengagement which cannot be performed by the user, and therefore misoperations of the user may be prevented. In order to prevent fracture of the second protrusion section 102 of the front wire holder 36*a* because of careless handling of the press rod by service technicians, a second sidewall 46 is provided behind the second protrusion section 102 at a distance "d". This distance "d" is set so that the second protrusion section 102 cannot be fractured even by excess pressing with the press rod 39. Here, the cross section of the opening section 44 for insertion of the press rod 39 which is provided in the front frame 38 is shaped as a square with a side (x) of 2–8 mm, or as a circle with ϕ 2–8 mm (see FIG. 3), which does not allow operation of the user with the finger.

The transferring charger unit 9 may be attached to the base plate 31 as follows. First, the two springs 33 for pressing the charger unit 9 upward are inserted into the holes of the base plate 31. The first protrusion section 101 of the rear wire holder 36*b* of the charger unit 9 is then inserted into the first engagement section 32*b* of the base plate 31. Thereafter, the second protrusion section 102 of the front wire holder 36*a* of the charger unit 9 is inserted into the guide port 48 of the front frame 38. Here, the unit 9 is pressed down against the upward movement forced by the springs 33 until the second protrusion section 102 becomes engaged with the second engagement section 32*a* of the base plate 31. Once the second protrusion section 102 becomes engaged with the second engagement section 32*a*, the unit 9 can no longer be disengaged from the base plate 31. The transferring charger unit 9 may be disengaged from the base plate 31 as described below. The press rod 39 is inserted into the opening section 44 of the front frame 38 and is pressed until the second protrusion section 102 comes into contact with the second wall 46 positioned behind it. This operation serves to disengage the second protrusion section 102 of the front wire holder 36*a* from the second engagement section 32*a* of the base plate 31. Here, the charger unit 9 may be extracted upward with the help of the force of the springs 33 which press the charger unit 9 upward. The press rod 39 is pulled out at the same time the unit 9 is pressed upward by the springs 33.

A second embodiment of the present invention will now be explained with reference to FIG. 5 and FIG. 6.

Figure 5:
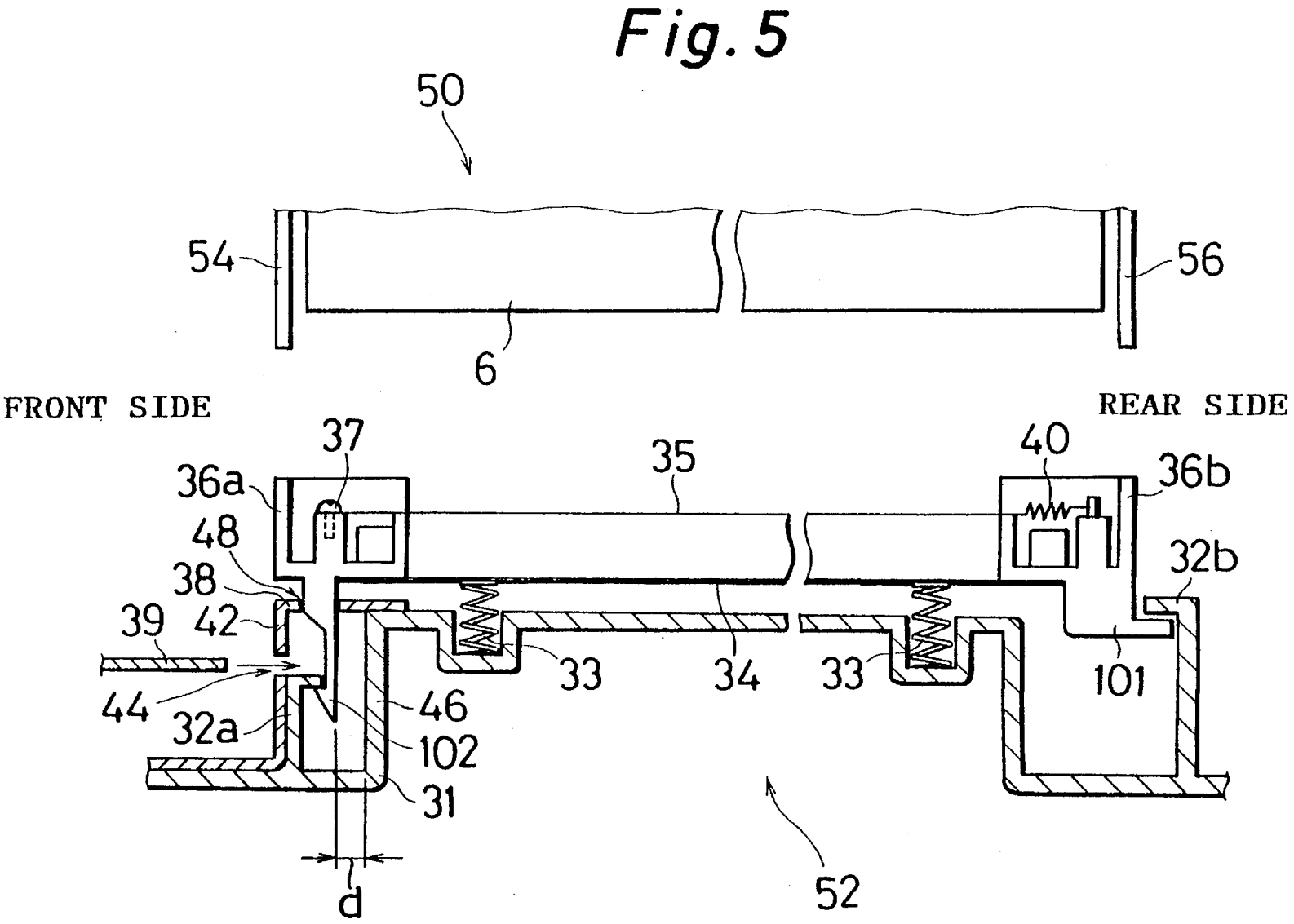
FIG. 5 is a cross sectional view of the corona charger type transferring device according to a second embodiment of the invention which is built in a xerographic apparatus, when viewed in the direction of the arrow B in FIG. 4.
Figure 6:
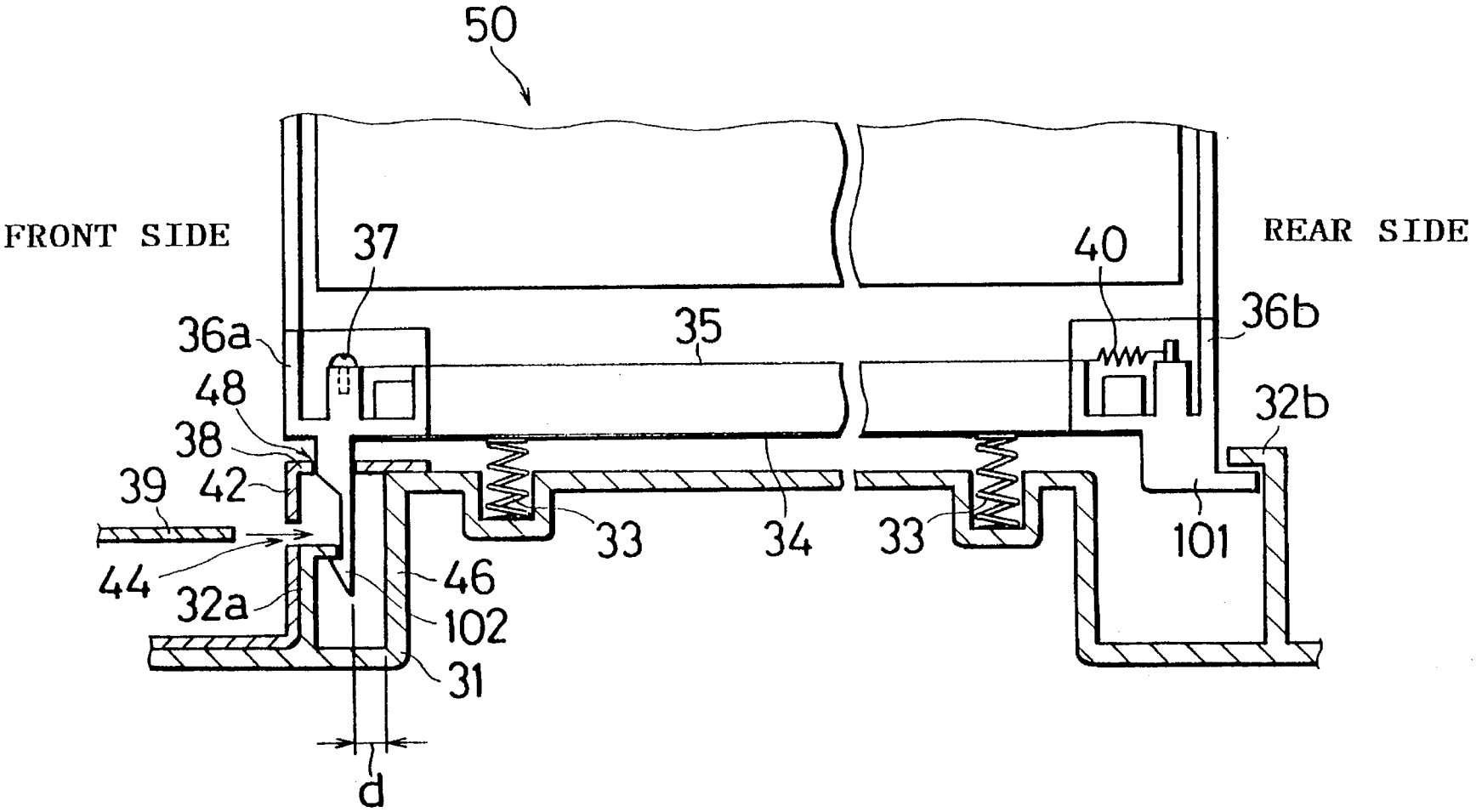
FIG. 6 is a cross sectional view of a corona charger type transferring device which is similar to FIG. 5, but showing the xerographic apparatus shown in FIG. 4 in a closed state.
Figure 7:
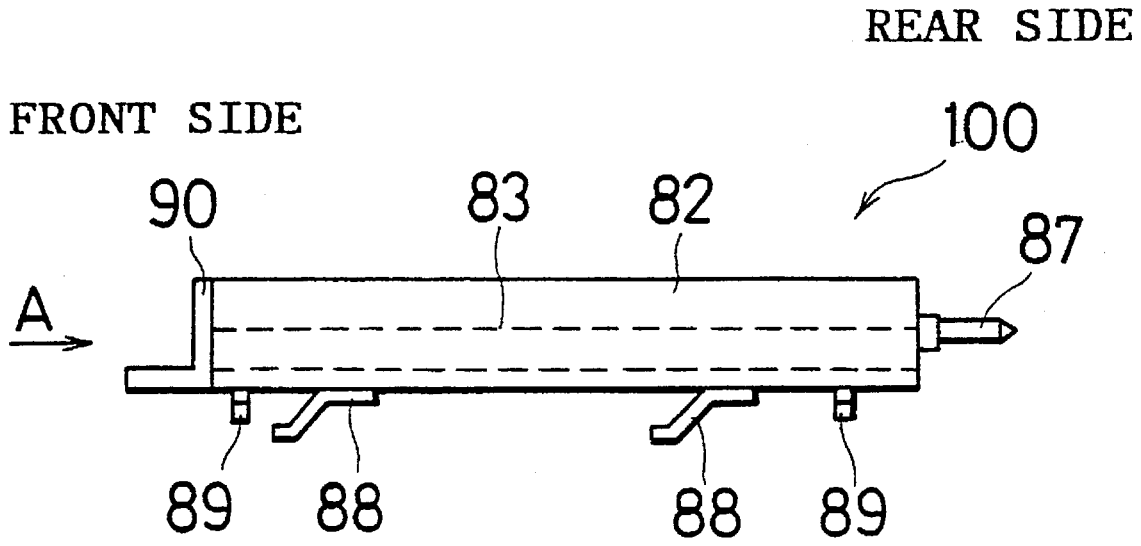
FIG. 7 is a side view of a corona charger type transferring device of the prior art.
Figure 8:
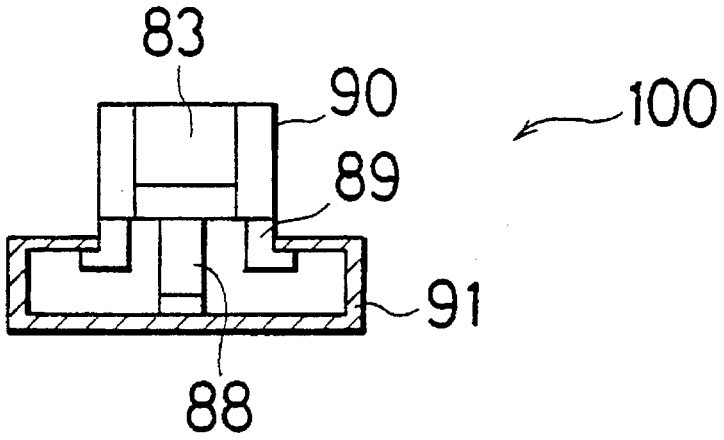
FIG. 8 is a cross sectional view of the corona charger type transferring device shown in FIG. 7, when viewed in the direction of the arrow A.
Figure 9:
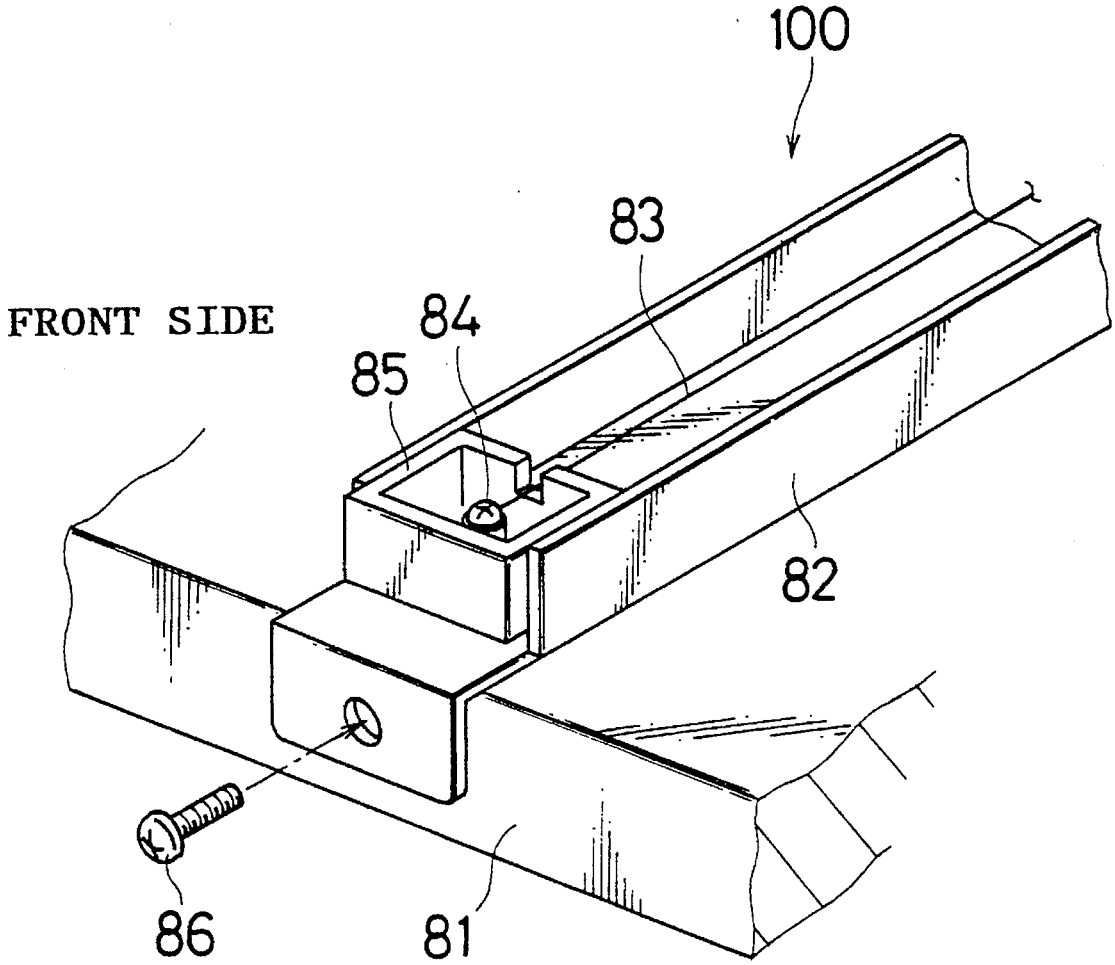
FIG. 9 is a perspective view of the main portion of a corona charger type transferring device of the prior art which illustrates how it is secured to the body of a xerographic apparatus.
Figure 10:
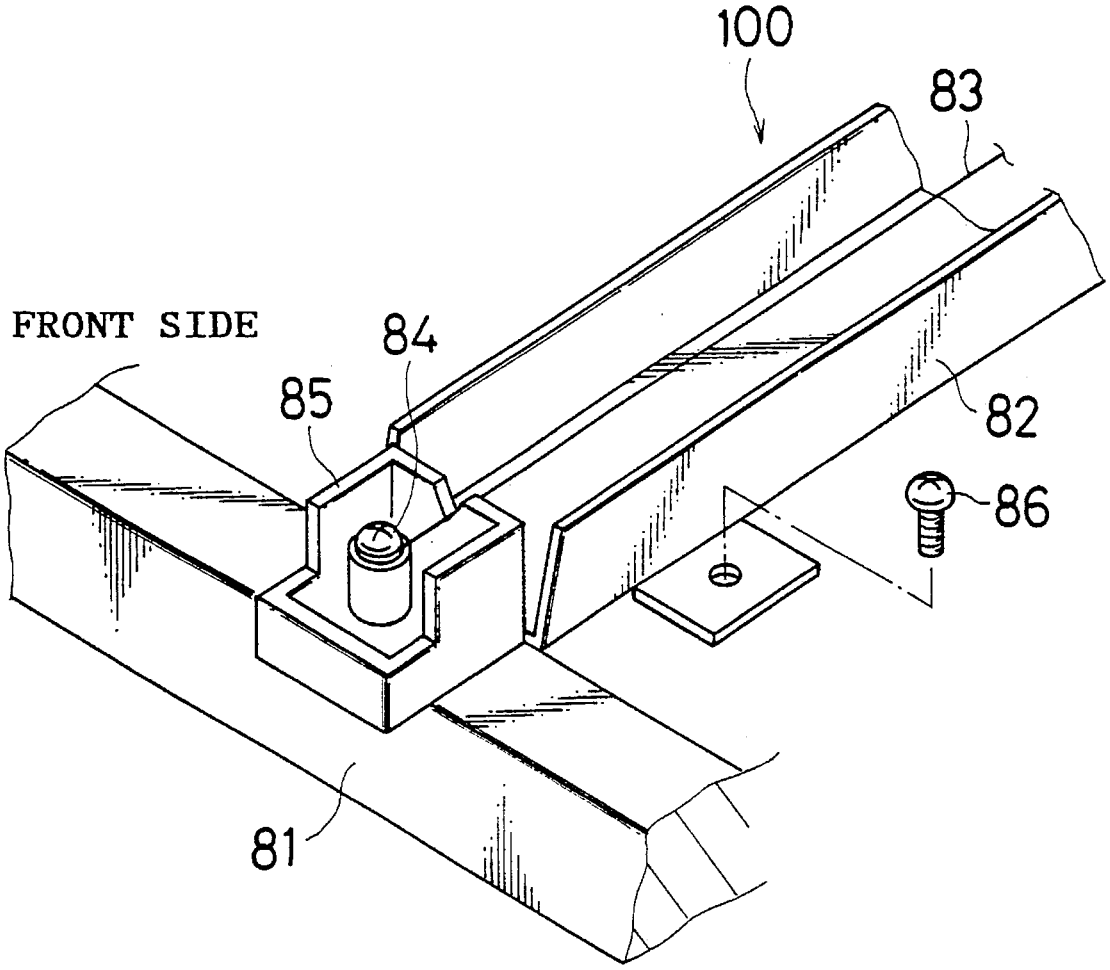
FIG. 10 is a perspective view of the main portion of a corona charger type transferring device of the prior art which illustrates how it is secured to the body of another xerographic apparatus.

FIG. 5 shows the upper unit 50 in an open state (a cross sectional view of the transferring charger unit 9 and photoconductor drum 6 when viewed in the direction of the arrow B in FIG. 4), while FIG. 6 shows the upper unit 50 in a closed state (a similar cross sectional view when viewed in the direction of the arrow B in FIG. 4, for example). The upward bias (in the direction toward the photoconductor drum 6) of the transferring charger unit 9 by the springs 33 for engagement of the second protrusion section 102 of the wire holder 36*a* with the second engagement section 32*a* and engagement of the first protrusion section 101 of the wire holder 36*b* with the first engagement section 32*b* regulates the upward movement of the transferring charger unit 9, but al lows its downward movement against the bias force of the springs 33. The body of the xerographic apparatus which is the second embodiment of the invention may be pivotably divided into the upper unit 50 which includes the photoconductor drum 6 and the lower unit 52 which includes the transferring charger unit 9. In cases where the upper unit 50 is opened, the upward bias of the transferring charger unit 9 by the bias force of the springs 33 for engagement of the second protrusion section 102 of the wire holder 36*a* with the second engagement section 32*a* and engagement of the first protrusion section 101 of the wire holder 36*b* with the first engagement section 32*b* regulates the upward movement of the transferring charger unit 9. When the upper unit 50 is closed, the front and rear ends (54, 56) of a drum-supporting frame which supports the photoconductor drum 6 come into contact with the front and rear wire holders 36*a* and 36*b* of the transferring charger unit 9 to facilitate the downward movement of the transferring charger unit 9 against the bias force of the springs 33. More specifically, contacting of the wire holders 36*a* and 38*b* with the front and rear ends of the drum-supporting frame allows upward biasing of the transferring charger unit 9 by the springs 33 to determine the positional relationship between the transferring charger unit 9 and photoconductor drum 6, that is, the distance between the charger wire 35 and photoconductor drum 6.

As is apparent from the aforementioned embodiments, according to the invention, a corona charger type transferring device may be attached to the body of a xerographic apparatus only by insertion, without using any special fitting parts (vises, metal fittings, etc.), and thus the working efficiency is improved. In addition, since the device once attached cannot be removed without using the special tool, there is no risk of the user removing it erroneously. In other words, prevention of mishandling by the user and improved working efficiency of the service technician are both accomplished.

Also according to the invention, accurate determination of the positional relationship between the transferring charger unit and photoconductor drum unit allows steady contact of the sheet with the photoconducuctor for drum and smooth peeling of the sheet from the photoconducuctor for drum, thus ensuring constant and proper transferring of the toner image formed on the photoconductor drum and peeling of the sheet from the photoconductor drum. Furthermore, although the positional relationship between the photoconductor drum and transferring charger unit in a xerographic apparatus which comprises an upper unit with a photoconductor drum unit and a lower unit with a transferring charger unit which are separable by pivoting, has been difficult to determine according to the prior art, it can be easily determined according to the present invention. Furthermore, even in cases where the transferring charger unit receives an impact when the upper unit is restored to its closed position, the impact may be absorbed since the transferring charger unit may freely move vertically, and thus the transferring charger unit never suffers fracturing.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A xerographic apparatus which is equipped with a detachable corona charger type transferring device including holders located at both ends of a charger box for fixing a charger wire thereto, the apparatus comprising:

a first engagement section which matches a first protrusion section provided at the holder located at one end of the transferring device for positioning with respect to the apparatus;

a second engagement section which matches a second elastically deformable protrusion section for engagement with the apparatus and which is provided at the holder located at the other end of the transferring device;

biasing means for biasing the transferring device upward; and a first sidewall having an opening section which is located facing the second protrusion section in order to confine the site of the second protrusion section to be subjected to elastic deformation by pressing and which allows the pressing therethrough, wherein the second engagement section releases engagement by virtue of elastic deformation of the second protrusion section due to the pressing.

2. A xerographic apparatus which is equipped with a detachable corona charger type transferring device including holders located at both ends of a charger box for fixing a charger wire thereto, the apparatus comprising:

a first engagement section which matches a first protrusion section provided at the holder located at one end of the transferring device for positioning with respect to the apparatus;

a second engagement section which matches a second elastically deformable protrusion section for engagement with the apparatus and which is provided at the holder located the other end of the transferring device;

biasing means for biasing the transferring device upward;

a first sidewall having an opening section which is located facing the second protrusion section in order to confine the site of the second protrusion section to be subjected to elastic deformation by pressing and which allows the pressing therethrough and; a second sidewall provided opposite to the first sidewall relative to the second protrusion section in order to prevent excess elastic deformation of the second protrusion section.

3. A xerographic apparatus which is equipped with a detachable corona charger type transferring device including holders located at both ends of a charger box for fixing a charger wire thereto, and which may be pivotably divided into an upper unit with a photoconductor drum unit and a lower unit with the transferring device, the apparatus comprising:

a first engagement section which matches a first protrusion section provided at the holder located at one end of the transferring device for positioning with respect to the apparatus;

a second engagement section which matches a second elastically deformable protrusion section for engagement with the apparatus and which is provided at the holder located at the other end of the transferring device;

biasing means for biasing the transferring device upward;

a first sidewall having an opening section which is located facing the second protrusion section in order to confine the site of the second protrusion section to be subjected to elastic deformation by pressing and allows the pressing therethrough, the second engagement section releasing engagement by virtue of elastic deformation of the second protrusion section due to the pressing; and positioning means provided at a side of the photoconductor drum unit for determining positional relationship between the photoconductor drum unit and transferring device only when in closed positions.

4. A xerographic apparatus which is equipped with a detachable corona charger type transferring device including holders located at both ends of a charger box for fixing a charger wire thereto, and which may be pivotably divided into an upper unit with photoconductor drum unit and a lower unit with the transferring device, the apparatus comprising:

a first engagement section which matches a first protrusion section provided at the holder located at one end of the transferring device for positioning with respect to the apparatus;

a second engagement section which matches a second elastically deformable protrusion section for engagement with the apparatus and which is provided at the holder located at the other end of the transferring device;

biasing means for biasing the transferring device upward;

a first sidewall having an opening section which is located facing the second protrusion section in order to confine the site of the second protrusion section to be subjected to elastic deformation by pressing and allows the pressing therethrough;

positioning means provided at a side of the photoconductor drum unit for determining positional relationship between the photoconductor drum unit and transferring device only when in closed positions further comprising a second sidewall provided opposite to the first sidewall relative to the second protrusion section in order to prevent excess elastic deformation of the second protrusion section.

* * * * *